United States Patent [19]

Fowler

[11] 3,967,687

[45] July 6, 1976

[54] CURB DRAIN HOLE DRILL

[76] Inventor: Dwight W. Fowler, 705 SW. 206th Ave., Aloha, Oreg. 97005

[22] Filed: July 29, 1974

[21] Appl. No.: 492,460

[52] U.S. Cl. ..... 173/32; 173/37; 248/279; 408/92; 408/99; 408/112

[51] Int. Cl.[2] ..... E01C 23/00

[58] Field of Search ..... 408/92, 99, 100, 111, 408/712; 173/32, 33, 37, 163, 141; 248/2, 279, 14, 12

[56] References Cited

UNITED STATES PATENTS

| | | | |
|---|---|---|---|
| 1,911,975 | 5/1933 | Smith, Sr. et al. | 173/32 X |
| 2,730,334 | 1/1956 | Sullivan | 173/33 X |
| 3,007,686 | 11/1961 | Pearson | 173/32 X |
| 3,538,794 | 11/1970 | Grundmeyer | 408/92 |
| 3,696,874 | 10/1972 | Brinkman | 173/163 X |
| 3,834,828 | 10/1974 | Kikuchi | 408/92 UX |

*Primary Examiner*—Ernest R. Purser
*Assistant Examiner*—William F. Pate, III
*Attorney, Agent, or Firm*—Klarquist, Sparkman, Campbell, Leigh, Hall & Whinston

[57] ABSTRACT

A drill apparatus for providing a drain hole in curbing comprises a core drill mounted for longitudinal movement along a horizontal post held between a drill frame and a hooking member positioned in hooking relation with the curb. The horizontal post is tightened in compression while a pair of chains extend between the hooking member and the drill frame for holding the frame in firm contact with the curbing.

5 Claims, 3 Drawing Figures

CURB DRAIN HOLE DRILL

BACKGROUND OF THE INVENTION

The present invention relates to apparatus for providing a drain in street curbing, and particularly to such a device for opening concrete curbing without requiring concrete patching after completion of the opening.

In many areas, a drain hole or "weep hole" is located through street curbing for the purpose of conveying run off water to the street and from there to a storm drain or the like. Thus, after a street with curbs has been completed, it frequently becomes necessary to remove a portion of the curbing for placement of a run off tile therethrough at street level wherein such tile communicates underground with building roof gutters. Conventionally, the curbing is manually broken with a sledge hammer or similar tool, after which the tile is correctly positioned and the curb is reformed thereover with fresh concrete. Not only is this process wasteful of materials and time, but it also frequently results in an unsightly curb formation with a new section of concrete which may break away from the originally poured curb as expansion takes place due to freezing conditions and the like.

SUMMARY OF THE INVENTION

According to the present invention, apparatus is provided for drilling a drain hole or weep hole in a curbing for placement of tile or pipe, without requiring destruction of the curb at the location of the hole and without requiring the pipe to be reconcreted in place. The apparatus comprises a frame for supporting a core drill by means of which the curb hole is drilled, and means for holding the frame in abutting relation to a curb including a hooking member disposed in hooking relation over the top of the curb and attached in tension relation to the drill frame. According to a preferred embodiment of the present invention, the apparatus includes a horizontal post disposed between the rearward part of the frame and the aforementioned hooking member and along which the drilling apparatus is transported for completing the hole.

It is an object of the present invention to provide an improved apparatus for drilling holes in street curbing for drainage purposes.

It is another object of the present invention to provide an improved apparatus for locating a drain in street curbing without requiring destruction and reformation of the curb.

It is a further object of the present invention to provide an improved apparatus for drilling holes in curbing which apparatus is efficient and simple to operate and rapidly produces the desired hole.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

DETAILED DESCRIPTION

Figure 1:
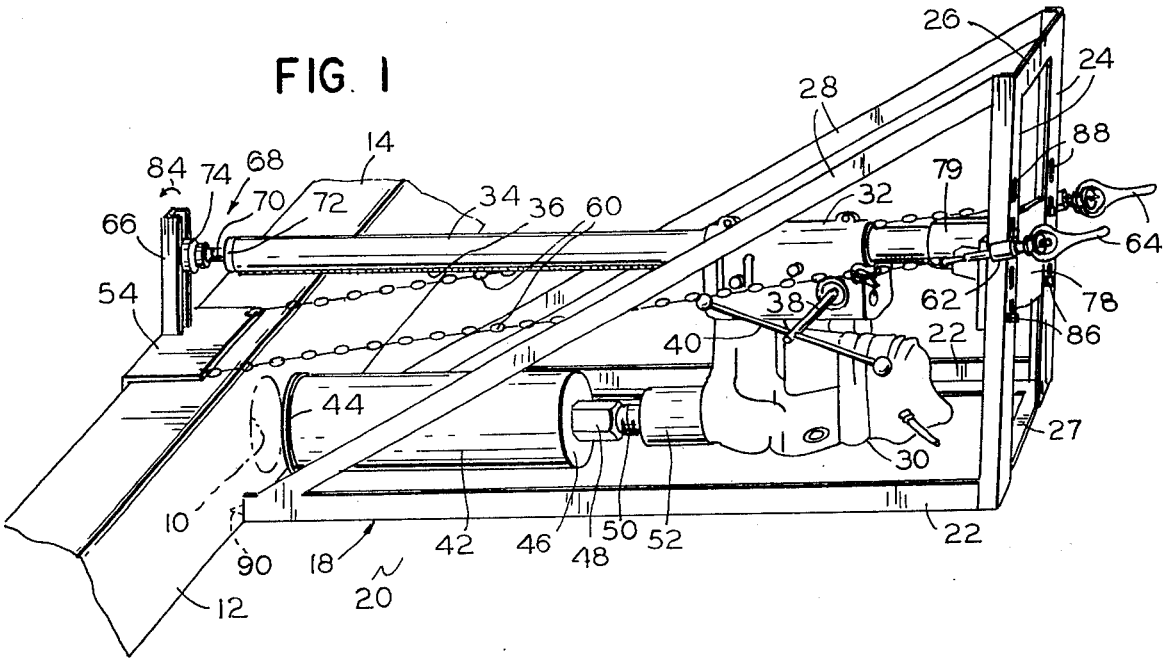
FIG. 1 is a perspective view of a curb drain drilling apparatus according to the present invention.
Figure 2:
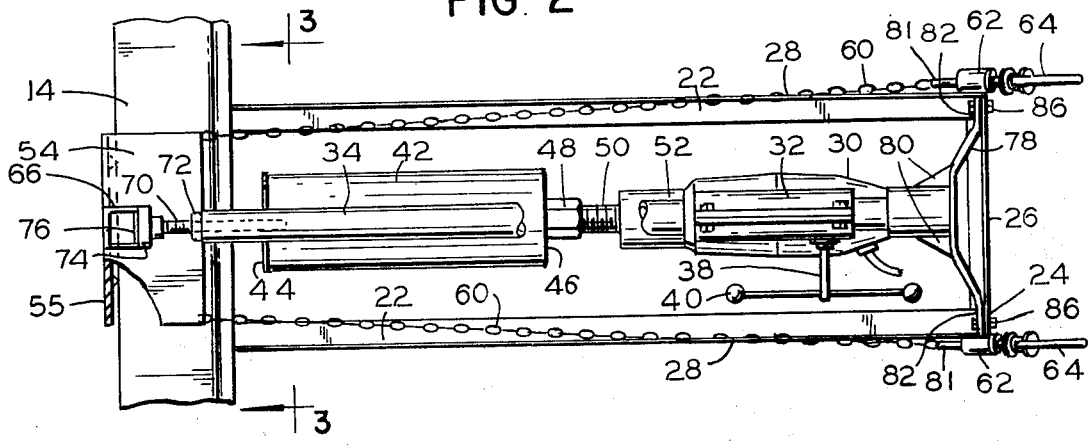
FIG. 2 is a top view of the FIG. 1 apparatus.
Figure 3:
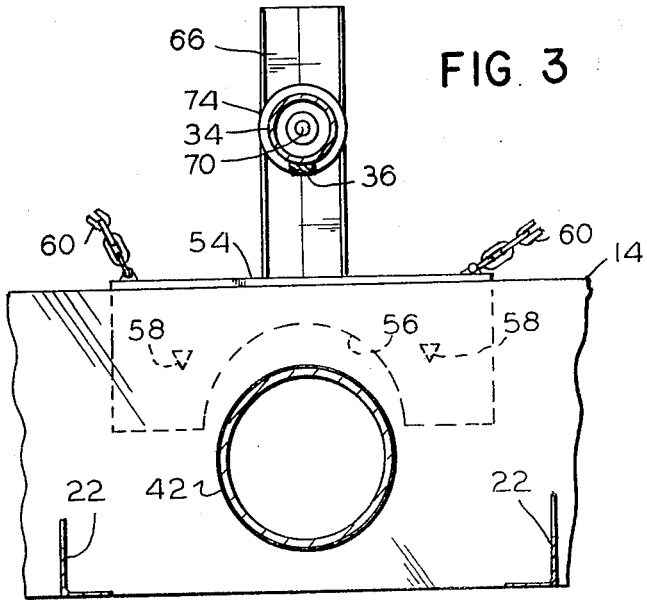
FIG. 3 is a cross sectional view of said apparatus taken at 3—3 in FIG. 2.

Referring to the drawings, the apparatus according to the present invention is adapted for drilling a drain hole indicated at 10 in the side wall or face 12 of a curb substantially adjacent street 20. The curb drain hole apparatus according to the present invention comprises a frame 18 including a pair of horizontal parallel legs 22 comprising steel angles adapted for support on the surface of the street and running forwardly in substantially perpendicular relation to the wall 12 of the curb on either side of the desired hole 10. The frame further comprises vertical members 24 comprising steel angles joined to horizontal members 22 at the ends thereof remote from the curb which are joined in spaced relation by upper and lower horizontal members 26 and 27. The frame additionally includes a pair of diagonal braces 28 extending from the upper ends of members 24 to nearly the forward ends of horizontal members 22.

The forward ends of horizontal members 22 are held in abutting relation with the wall 12 of the curb by means of a pair of chains 60 extending from the near edge of a hooking member 54 to locations on vertical frame members 24 provided with tubular lugs 62 welded to the sides thereof through which pass bolt extensions 81 secured to the chain ends. The bolt extensions are engaged by tightening means comprising handle nuts 64 utilized for placing the chains 60 under tension for drawing the frame 18 up tight against the curb. Moreover, the forward ends of members 22 are desirably provided with spikes 90 which engage the curb, with the curb desirably being punched or drilled beforehand to receive said spikes.

The hooking member 54 rests upon the upper face 14 of the curb and is provided with a downwardly extending vertical portion 55 which hooks over the rear side of the curb where such vertical portion is provided with a pair of spur projections or push outs 58 which are stamped from the portion 55. Alternatively, the forward side of portion 55 may be provided with some other form of irregular surface such as a hooked edge for engaging the rear of the concrete curb. Furthermore, portion 55 is cut out at 56 to provide a semi-circular opening somewhat larger than the desired hole 10 to allow passage of the drill.

The hooking member 54 further includes an upwardly extending leg 66 comprising a channel welded at one end to the rear top portion of the hooking member and open toward the frame 18. The leg 66 receives the end 74 of foot 68 having a threaded shank 70 for engaging threaded nut 72 joined to one end of a substantially horizontal post 34. Post 34 is substantially cylindrical and is provided with a toothed rack 36 on the under side thereof for engaging the teeth of a pinion (not shown) journaled within support slide 32, the pinion being rotated by shaft 38 carrying a hand lever wheel 40. Slide 32 supports hydraulic or electrical driving motor 30 for core drill bit 42, the rear end of which is closed by a disc shaped wall 46 welded to a threaded connection 50 by means of which the drill bit is secured to the threaded operating spindle 50 of driving motor 30. The drill bit 42 is tubular in shape and has a cutting edge 44 at its forward end for drilling through the concrete curb. The post 34 is adapted to position the drill bit 42 between frame members 22 for drilling the desired hole 10 through face 12 of the curb.

The rear of post 34 is provided with a saddle bracket 78 having its forward portion removably joined to the end of post 34 by means of retainer 79 braced against saddle bracket 78 by means of angular braces 80. The saddle bracket 78 is bent rearwardly from the position of braces 80, ending in foot portions 82 which are parallel to and abut the inside rear wall of angle members 24 where means are provided for removably securing the saddle bracket to the angle members 24. Such means suitably comprise bolts 86 extending through slots 88 in angle members 24 and aligned holes in foot portions 82. The saddle bracket 78 is movable vertically for positioning the drill by loosening the bolts 86 for movement along slots 82 or by insertion of the same into a different set of slots in vertical angle members 24.

In operation of the device according to the present invention, the frame 18 is placed against curb wall 12 with the forward ends of members 22 in abutting relation to the curb, and hooking member 54 is placed over the top of the curb as illustrated. The chain end bolt extensions 81 are secured through tubular lugs 62 and handle nuts 64 are tightened to hold the frame against the curb. Also, foot 68 of post 34 is positioned in engagement with upright leg 66 of the hooking member, and the end 74 of foot 68 is rotated for placing the post 34 in compression between the upward leg 66 and the frame 18. At this time, the upward leg 66 will tend to rotate somewhat in a counterclockwise direction as indicated by arrow 84 which tends to cause spur push outs 58 to dig into the rear of the curb, while placing the chains 60 under additional tension whereby the frame is securely held against the curb. Also, of course, the horizontal post 34 is securely held whereby the drill bit 42 may be moved towards the curb by rotation of hand lever wheel 40 without downward movement of the horizontal post 34 as a result of the weight placed thereupon. Urging the core drill bit forwardly drills a hole at the location indicated through which a tile or pipe may be positioned.

While I have shown and described a preferred embodiment of my invention, it will be apparent to those skilled in the art that many changes and modifications may be made without departing from my invention in its broader aspects. I therefore intend the appended claims to cover all such changes and modificatons as fall within the true spirit and scope of my invention.

I claim:

1. Apparatus for drilling a drain hole in a curb forming the edge of a street, said apparatus comprising:

a horizontal support frame adapted to be placed in the street next to the curb in which the drain hole is desired, said frame including horizontally extending legs for abutting the curb on either side of the location of the desired hole, and adapted for supporting a horizontally disposed core drill extending longitudinally of said frame, a hooking member for placement over the top edge of said curb and including a downwardly extending portion for engaging the rear of said curb, wherein said hooking member is provided with a leg extending above the level of said curb and horizontal post means interposed between said frame and said leg for applying force toward said leg from the direction of said frame, and a pair of chains attached to said hooking member for urging said frame toward said curb including a pair of tightening means for securing said chains relative to said frame.

2. Apparatus for drilling a drain hole in a curb forming the edge of a street, said apparatus comprising:

a horizontal support frame adapted to be placed in the street next to the curb in which the drain hole is desired, said frame including horizontally extending legs for abutting the curb on either side of the location of the desired hole, and adapted for supporting a horizontally disposed core drill extending longitudinally of said frame, a hooking member for placement over the top edge of said curb and including a downwardly extending portion for engaging the rear of said curb, wherein said downwardly extending portion of said hooking member is provided with an irregular surface adapted to engage the rear of said curb, and a pair of chains attached to said hooking member for urging said frame toward said curb including a pair of tightening means for securing said chains relative to said frame.

3. Apparatus for drilling a drain hole in a curb forming the edge of a street, said apparatus comprising:

a horizontal support frame adapted to be placed in the street next to the curb in which the drain hole is desired, said frame including horizontally extending legs for abutting the curb on either side of the location of the desired hole, and adapted for supporting a horizontally disposed core drill extending longitudinally of said frame, wherein said horizontally extending legs are provided with forward spikes for engaging said curb on either side of the location of said hole, a hooking member for placement over the top edge of said curb and including a downwardly extending portion for engaging the rear of said curb, and a pair of chains attached to said hooking member for urging said frame toward said curb including a pair of tightening means for securing said chains relative to said frame.

4. The apparatus according to claim 1 wherein said horizontal post means interposed between said frame and said leg carries said core drill, said post being provided with a rack for engaging the teeth of a pinion carried by said core drill for moving said core drill along said horizontal post.

5. The apparatus according to claim 4 wherein said post is provided with a screw foot for engaging said leg.

* * * * *